US008298351B2

(12) United States Patent
Fukui et al.

(10) Patent No.: US 8,298,351 B2
(45) Date of Patent: Oct. 30, 2012

(54) R-T-B RARE EARTH SINTERED MAGNET

(75) Inventors: Kazuya Fukui, Echizen (JP); Takahiro Hashimoto, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 13/103,426

(22) Filed: May 9, 2011

(65) Prior Publication Data

US 2011/0279205 A1 Nov. 17, 2011

(30) Foreign Application Priority Data

May 14, 2010 (JP) ..... 2010-111743

(51) Int. Cl.
*H01F 1/057* (2006.01)

(52) U.S. Cl. ..... 148/302; 148/303

(58) Field of Classification Search ..... None
See application file for complete search history.

(56) References Cited

U.S. PATENT DOCUMENTS 5,015,307 A 5/1991 Shimotomai et al.
5,089,066 A 2/1992 Hamada et al.
5,482,575 A 1/1996 Barzasi et al.
2002/0139447 A1 10/2002 Hirosawa et al.
2007/0240790 A1* 10/2007 Kita et al. ..... 148/105
2010/0233016 A1* 9/2010 Tsubokura et al. ..... 420/83

FOREIGN PATENT DOCUMENTS

CN 1033899 A 7/1989
EP 0311049 B1 1/1994
JP 1-220803 * 9/1989
JP 02-004939 A 1/1990
JP 2003-041303 A 2/2003

OTHER PUBLICATIONS

At-Wt Converter, No Date.*
European Search Report dated Jul. 6, 2011, issued in corresponding European Patent Application No. 11165529.6.

* cited by examiner

*Primary Examiner* — John Sheehan
(74) *Attorney, Agent, or Firm* — Westerman, Hattori, Daniels & Adrian, LLP

(57) ABSTRACT

A rare earth sintered magnet consists essentially of 26-36 wt % R, 0.5-1.5 wt % B, 0.1-2.0 wt % Ni, 0.1-3.0 wt % Si, 0.05-1.0 wt % Cu, 0.05-4.0 wt % M, and the balance of T and incidental impurities wherein R is a rare earth element, T is Fe or Fe and Co, M is selected from Ga, Zr, Nb, Hf, Ta, W, Mo, Al, V, Cr, Ti, Ag, Mn, Ge, Sn, Bi, Pb, and Zn. Simultaneous addition of Ni, Si, and Cu ensures magnetic properties and corrosion resistance.

5 Claims, 2 Drawing Sheets

R-T-B RARE EARTH SINTERED MAGNET

CROSS-REFERENCE TO RELATED APPLICATION

This non-provisional application claims priority under 35 U.S.C. §119(a) on Patent Application No. 2010-111743 filed in Japan on May 14, 2010, the entire contents of which are hereby incorporated by reference.

TECHNICAL FIELD

This invention relates to a rare earth sintered magnet having improved magnetic properties and corrosion resistance.

BACKGROUND ART

Nd—Fe—B magnets not only have excellent magnetic properties as typified by a maximum energy product about 10 times that of ferrite magnets, but are also manufactured at relatively low cost by combining iron with B and Nd which is relatively inexpensive, abundant in resource and commercially available in a stable supply. For these reasons, Nd—Fe—B magnets are utilized in a wide variety of products like electronic equipment and also employed in motors and power generators on hybrid vehicles. The demand for Nd—Fe—B magnets is increasing.

Although Nd—Fe—B magnets have excellent magnetic properties, they are less corrosion resistant because they are based on Fe and Nd, a light rare earth. Even in an ordinary atmosphere, rust forms with the lapse of time. Often Nd—Fe—B magnet blocks are covered on their surface with a protective layer of resin or plating.

JP-A H02-004939 discloses multiple substitution of Co and Ni for part of Fe as an effective means for improving the corrosion resistance of a magnet body. This approach, however, is not practically acceptable because of the problem that the magnet suffers a substantial loss of coercive force when Ni substitutes for part of Fe.

CITATION LIST

Patent Document 1: JP-A H02-004939 (U.S. Pat. No. 5,015,307, EP 0311049, CN 1033899)

DISCLOSURE OF INVENTION

An object of the invention is to provide a rare earth sintered magnet having improved magnetic properties and high corrosion resistance.

The inventors have found that the problem of a Nd—Fe—B sintered magnet that it suffers a loss of coercive force when Ni is substituted for part of Fe for the purpose of improving corrosion resistance is overcome by adding a combination of Si and Cu along with Ni. That is, the addition of Si and Cu combined with Ni is effective for improving corrosion resistance and inhibiting any loss of coercive force.

The invention provides a R-T-B rare earth sintered magnet in the form of a sintered body having a composition including R, T, B, Ni, Si, Cu, and M, wherein R is one or more element selected from rare earth elements inclusive of Y and Sc, T is Fe or Fe and Co, M is one or more element selected from the group consisting of Ga, Zr, Nb, Hf, Ta, W, Mo, Al, V, Cr, Ti, Ag, Mn, Ge, Sn, Bi, Pb, and Zn, said composition consisting essentially of, in % by weight, 26 to 36% of R, 0.5 to 1.5% of B, 0.1 to 2.0% of Ni, 0.1 to 3.0% of Si, 0.05 to 1.0% of Cu, 0.05 to 4.0% of M, and the balance of T and incidental impurities.

In a preferred embodiment, the sintered body contains one or more element selected from 0, C, and N as the incidental impurities. More preferably, the sintered body has an oxygen (O) content of up to 8,000 ppm, a carbon (C) content of up to 2,000 ppm, and a nitrogen (N) content of up to 1,000 ppm.

In a preferred embodiment, the sintered body contains a $R_2$-$T_{14}$-$B_1$ phase as the primary phase, said phase having an average grain size of 3.0 to 10.0 μm. Also preferably, a phase of a compound containing R, Co, Si, Ni, and Cu precipitates within the sintered body.

ADVANTAGEOUS EFFECT OF INVENTION

The Nd—Fe—B rare earth sintered magnet exhibits excellent magnetic properties and high corrosion resistance because of multiple addition of Ni, Si, and Cu.

DESCRIPTION OF EMBODIMENTS

Figure 1:
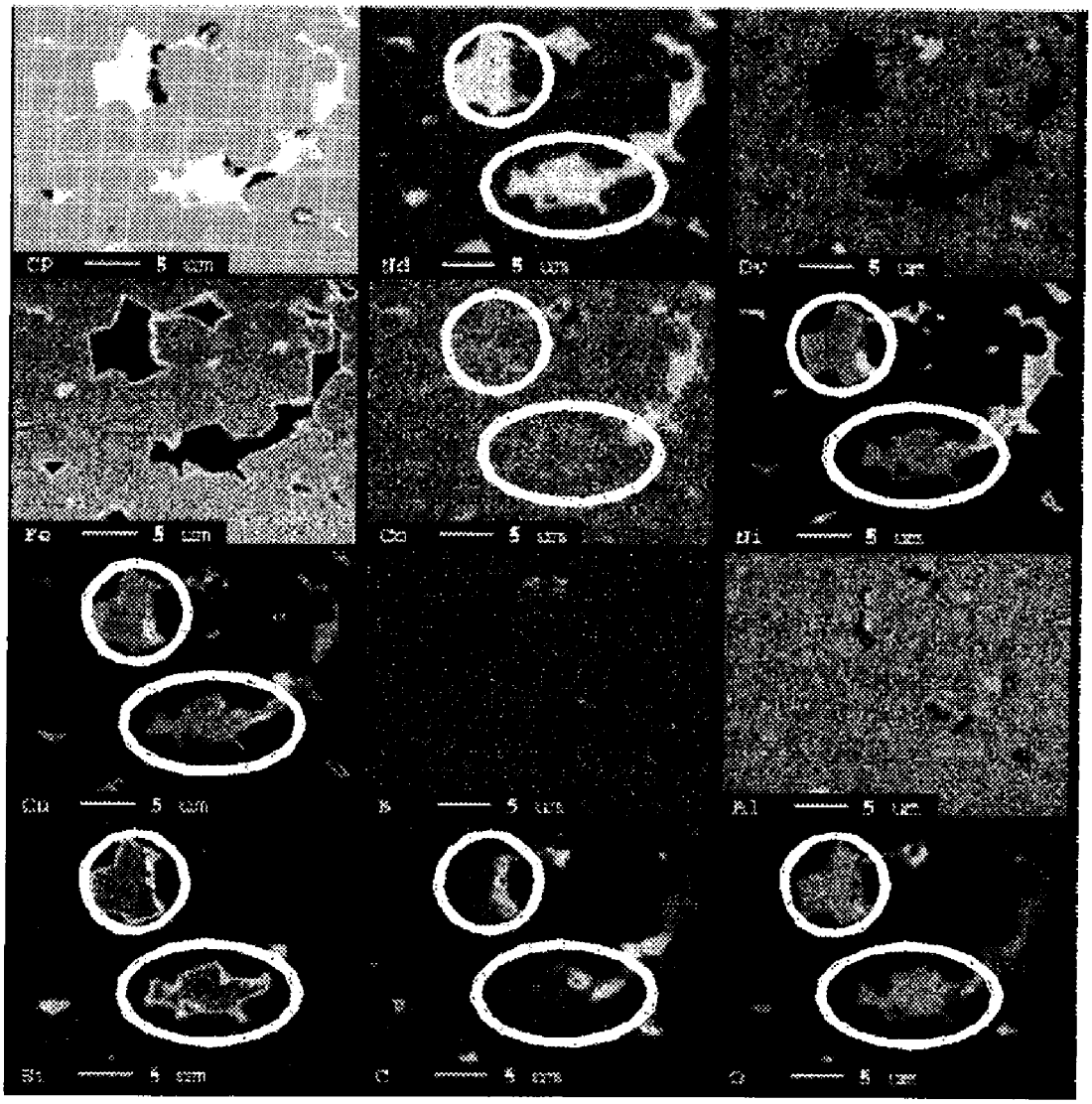
FIG. 1 is an electron micrograph and EPMA images of the sintered magnet in Example 2.

The R-T-B system rare earth sintered magnet of the invention includes R, T, B, Ni, Si, Cu, and M. Herein R is one element or a combination of two or more elements selected from rare earth elements inclusive of Y and Sc; T is Fe or a mixture of Fe and Co; M is one element or a combination of two or more elements selected from the group consisting of Ga, Zr, Nb, Hf, Ta, W, Mo, Al, V, Cr, Ti, Ag, Mn, Ge, Sn, Bi, Pb, and Zn.

R is one element or a combination of two or more elements selected from rare earth elements inclusive of Y and Sc, specifically from the group consisting of Y, Sc, La, Ce, Pr, Nd, Sm, Eu, Gd, Tb, Dy, Ho, Er, Yb, and Lu. Of these, Nd, Pr and Dy are preferred. Although a single rare earth element may be used, a combination of two or more rare earth elements is preferably used. Specifically, a combination of Nd and Dy, a combination of Nd and Pr, and a combination of Nd with Pr and Dy are preferred.

If the content of R in the sintered body is less than 26% by weight, there is a strong possibility of coercive force being substantially reduced. If the content of R is more than 36% by weight, which indicates a more than necessity amount of R-rich phase, there is a strong possibility that residual magnetization is reduced and eventually magnetic properties are degraded. Thus the content of R in the sintered body is preferably in a range of 26 to 36% by weight. A range of 27 to 29% by weight is more preferred in that the precipitation of fine α-Fe phase in the four-phase coexistence region is easily controllable.

The R-T-B rare earth sintered magnet contains boron (B). If the content of B is less than 0.5% by weight, a substantial drop of coercive force occurs due to the precipitation of $Nd_2Fe_{17}$ phase. If the content of B exceeds 1.5% by weight, which indicates an increased amount of B-rich phase (which varies with a particular composition, but is often $Nd_{1+\alpha}Fe_4B_4$ phase), residual magnetization is reduced. Thus the content of B in the sintered body is preferably in a range of 0.5 to 1.5% by weight, more preferably 0.8 to 1.3% by weight.

The R-T-B rare earth sintered magnet essentially contains three components of nickel (Ni), silicon (Si), and copper (Cu). Addition of Ni to rare earth sintered magnet is effective for improving the corrosion resistance thereof. However, the addition of Ni alone attains the improvement at the sacrifice of coercive force. The addition of all three components of Ni, Si, and Cu makes it possible to prevent the rare earth sintered magnet from losing its coercive force while improving the corrosion resistance thereof.

A Ni content of less than 0.1% by weight fails to provide sufficient corrosion resistance whereas a Ni content in excess of 2.0% by weight results in substantial drops of residual magnetization and coercive force. Thus the content of Ni in the sintered body is preferably in a range of 0.1 to 2.0% by weight, more preferably 0.2 to 1.0% by weight.

A Si content of less than 0.1% by weight is insufficient to restore the coercive force which is reduced by addition of Ni whereas a Si content in excess of 3.0% by weight results in a substantial drop of residual magnetization. Thus the content of Si in the sintered body is preferably in a range of 0.1 to 3.0% by weight, more preferably 0.2 to 1.5% by weight.

A Cu content of less than 0.05% by weight is least effective to increase the coercive force (iHc) whereas a Cu content in excess of 1.0% by weight results in a substantial drop of residual magnetic flux density (Br). Thus the content of Cu in the sintered body is preferably in a range of 0.05 to 1.0% by weight, more preferably 0.1 to 0.4% by weight.

The R-T-B rare earth sintered magnet further contains additive element M which is one element or a combination of two or more elements selected from the group consisting of Ga, Zr, Nb, Hf, Ta, W, Mo, Al, V, Cr, Ti, Ag, Mn, Ge, Sn, Bi, Pb, and Zn. Of these, Ga, Zr, Nb, Hf, Al, and Ti are preferred.

The additive element M is used, depending on a particular purpose, for example, for increasing coercive force. A M content of less than 0.05% by weight may exert no substantial effect whereas a M content in excess of 4.0% by weight may lead to a substantial drop of residual magnetization. Thus the content of M in the sintered body is preferably in a range of 0.05 to 4.0% by weight, more preferably 0.1 to 2.0% by weight.

The R-T-B rare earth sintered magnet contains T which is Fe or a mixture of Fe and Co. The content of T is the balance given by subtracting the contents of R, B, Ni, Si, Cu, M, and incidental impurities from the total weight (100% by weight) of the sintered body.

Generally the R-T-B rare earth sintered magnet contains incidental impurities (elements other than the above specified). Such impurities do not affect the magnetic properties of the magnet insofar as their content is insignificant. Usually incidental impurities are present in an amount of preferably up to 1% by weight (10,000 ppm).

Typical incidental impurities are oxygen (O), carbon (C), and nitrogen (N). The rare earth sintered magnet may contain one or more element selected from among O, C, and N. For convenience of the following description, it is noted that a rare earth sintered magnet is generally manufactured by crushing a mother alloy, pulverizing, compacting and sintering the molded compact, and that the rare earth sintered magnet is of an alloy system susceptible to oxidation.

The rare earth sintered magnet manufactured by the standard method may contain oxygen since the oxygen concentration increases in the pulverizing step. The content of oxygen resulting from the standard manufacture method does not adversely affect the benefits of the invention. However, if the oxygen content in the sintered body is in excess of 8,000 ppm, residual magnetic flux density and coercive force can be substantially reduced. Thus the oxygen content is preferably up to 8,000 ppm, more preferably up to 5,000 ppm. The magnet manufactured by the standard method often contains at least 500 ppm of oxygen.

Also the rare earth sintered magnet may contain carbon. Carbon is introduced from a lubricant or another additive (which lubricant may be added in the method for manufacturing magnet, if desired, for improving the residual magnetic flux density thereof), or as an incidental impurity in the starting material, or when a carbon-providing material is added for the purpose of substituting carbon for part of boron. The content of carbon resulting from the standard manufacture method does not adversely affect the benefits of the invention. However, if the carbon content in the sintered body is in excess of 2,000 ppm, coercive force can be substantially reduced. Thus the carbon content is preferably up to 2,000 ppm, more preferably up to 1,000 ppm. The magnet manufactured by the standard method often contains at least 300 ppm of carbon.

Further the rare earth sintered magnet may contain nitrogen since the pulverizing step is often performed in a nitrogen atmosphere. The content of nitrogen resulting from the standard manufacture method does not adversely affect the benefits of the invention. However, if the nitrogen content in the sintered body is in excess of 1,000 ppm, sinterability and squareness can be degraded and coercive force substantially reduced. Thus the nitrogen content is preferably up to 1,000 ppm, more preferably up to 500 ppm. The magnet manufactured by the standard method often contains at least 100 ppm of nitrogen.

Common R-T-B rare earth sintered magnets are composed of crystalline phases and contain a phase of $R_2$-$T_{14}$-$B_1$ compound as the primary phase. The R-T-B rare earth sintered magnet of the invention contains the $R_2$-$T_{14}$-$B_1$ phase as well. Corrosion resistance does not depend on the average grain size of the $R_2$-$T_{14}$-$B_1$ phase. If the average grain size is less than 3.0 μm, the sintered body may have a lower degree of orientation and hence, a lower residual magnetic flux density. An average grain size in excess of 10.0 μm may lead to a drop of coercive force. Thus the $R_2$-$T_{14}$-$B_1$ phase preferably has an average grain size of 3.0 to 10.0 μm.

In a Nd—Fe—B rare earth sintered magnet, the grain boundary phase within the sintered body plays a great role in the development of coercive force. Also from the standpoint of corrosion resistance, it is important to inhibit the grain boundary phase from degradation. The Nd—Fe—B rare earth sintered magnet of the invention meets both corrosion resistance and magnetic properties by virtue of the multiple addition of Ni, Si, and Cu. Specifically, the Nd—Fe—B rare earth sintered magnet of the invention is structured such that a phase of a compound containing R, Co, Si, Ni, and Cu, more specifically a compound containing R, Co, Si, Ni, Cu, and one or more of O, C, and N precipitates as the grain boundary phase within the sintered body. The presence of this phase contributes to high corrosion resistance and excellent magnetic properties.

The Nd—Fe—B rare earth sintered magnet is generally manufactured by a standard method, specifically by crushing a mother alloy, pulverizing, compacting and sintering the molded compact.

The mother alloy may be prepared by melting metal or alloy feeds in vacuum or an inert gas atmosphere, preferably argon atmosphere, and casting the melt in a flat mold or book mold, or strip casting. A possible alternative is a so-called two-alloy process involving separately preparing an alloy approximate to the $R_2$-$T_{14}$-$B_1$ phase constituting the primary phase of the Nd—Fe—B rare earth sintered magnet and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of $R_2$-$T_{14}$-$B_1$ phase, since α-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, a so-called melt quenching technique is applicable as well as the above-described casting technique.

The mother alloy is generally crushed to a size of 0.05 to 3 mm, preferably 0.05 to 1.5 mm. The crushing step uses a Brown mill or hydriding pulverization, with the hydriding pulverization being preferred for those alloys as strip cast. The coarse powder is then finely divided to a size of generally 0.2 to 30 μm, preferably 0.5 to 20 μm, for example, by a jet mill using nitrogen under pressure. If desired, a lubricant or another additive may be added in any of crushing, mixing and pulverizing steps.

The fine powder is then compacted under a magnetic field on a compression molding machine and the molded compact is placed in a sintering furnace. Sintering is effected in vacuum or in an inert gas atmosphere usually at a temperature of 900 to 1,250° C., preferably 1,000 to 1,100° C. for 0.5 to 5 hours. The magnet block as sintered is then cooled and subjected to optional heat treatment or aging treatment in vacuum or an inert atmosphere at 300 to 600° C. for 0.5 to 5 hours. In this way, the Nd—Fe—B rare earth sintered magnet of the invention is obtained.

EXAMPLE

Examples of the present invention are given below by way of illustration and not by way of limitation.

Examples 1 to 4 and Comparative Examples 1 to 6

Starting feeds including Nd, electrolytic iron, Co, ferroboron, Al, Cu, Ni, and ferrosilicon were combined in the following composition (in weight ratio): 27.5 Nd-5.0 Dy-bal Fe-1.0 Co-1.0 B-0.2 Al-0.1 Cu-0.5 Ni-y Si (y=0, 0.2, 0.4, 0.6, 0.8) or 27.5 Nd-5.0 Dy-bal Fe-1.0 Co-1.0 B-0.2 Al-0.1 Cu-x Ni (x=0, 0.2, 0.4, 0.6, 0.8). The mixture was melted in a high-frequency furnace in an Ar atmosphere and cast into an ingot. The ingot was subjected to solution treatment in an Ar atmosphere at 1,120° C. for 12 hours. The resulting alloy was crushed in a nitrogen atmosphere to a size of under 30 mesh. On a V-mixer, 0.1 wt % of lauric acid as a lubricant was mixed with the coarse powder. On a jet mill using nitrogen gas under pressure, the coarse powder was finely divided into a powder with an average particle size of about 5 μm. The fine powder was filled into a mold of a compactor, oriented in a magnetic field of 15 kOe, and compacted under a pressure of 0.5 ton/$cm^2$ in a direction perpendicular to the magnetic field. The molded compact was sintered in an Ar atmosphere at 1,100° C. for 2 hours, cooled, and heat treated in an Ar atmosphere at 500° C. for 1 hour. In this way, sintered magnet blocks of different composition were obtained.

The sintered magnet blocks were evaluated for magnetic properties and corrosion resistance. Magnetic properties (residual magnetic flux density and coercive force) were measured by a BH tracer. Corrosion resistance was examined by a pressure cooker test (PCT) of holding a sample at 120° C. and 2 atmospheres for 100 hours. A weight loss of the sample per surface area of the sample prior to the test was determined.

The magnetic properties measured and the PCT results are shown in Table 1. A comparison of Examples 1 to 4 to which 0.5 wt % Ni and Si were added with Comparative Example 4 to which 0.5 wt % Ni was added, but no Si added reveals that the addition of Si contributes to an improvement in corrosion resistance. It is also seen from Table 1 that when an attempt is made to improve corrosion resistance by increasing the amount of Ni added in the absence of Si, coercive force declines as the amount of Ni added increases. In particular, a significant loss of coercive force occurs in the high corrosion resistance region where the weight loss of PCT is below 5 g/$cm^2$. In contrast, Examples 1 to 4 having both Ni and Si added demonstrate that as the amount of Si added increases, coercive force increases and corrosion resistance improves. Examples 1 to 4 having Si added are superior in magnetic properties and corrosion resistance to Comparative Examples 5 and 6 having higher contents of Ni.

TABLE 1

| | | Ni (wt %) | Si (wt %) | Cu (wt %) | Br (kG) | iHc (kOe) | Weight loss by PCT (g/$cm^2$) |
|---|---|---|---|---|---|---|---|
| Example | 1 | 0.5 | 0.2 | 0.1 | 12.70 | 19.82 | 1.3 |
| | 2 | 0.5 | 0.4 | 0.1 | 12.59 | 20.76 | 0.7 |
| | 3 | 0.5 | 0.6 | 0.1 | 12.47 | 21.59 | 0.3 |
| | 4 | 0.5 | 0.8 | 0.1 | 12.34 | 22.35 | 0.2 |
| Comparative Example | 1 | 0 | 0 | 0.1 | 13.01 | 21.01 | 105.2 |
| | 2 | 0.2 | 0 | 0.1 | 12.91 | 20.53 | 52.5 |
| | 3 | 0.4 | 0 | 0.1 | 12.86 | 19.32 | 13.1 |
| | 4 | 0.5 | 0 | 0.1 | 12.82 | 18.81 | 10.5 |
| | 5 | 0.6 | 0 | 0.1 | 12.77 | 17.26 | 6.5 |
| | 6 | 0.8 | 0 | 0.1 | 12.65 | 14.55 | 1.6 |

Figure 2:
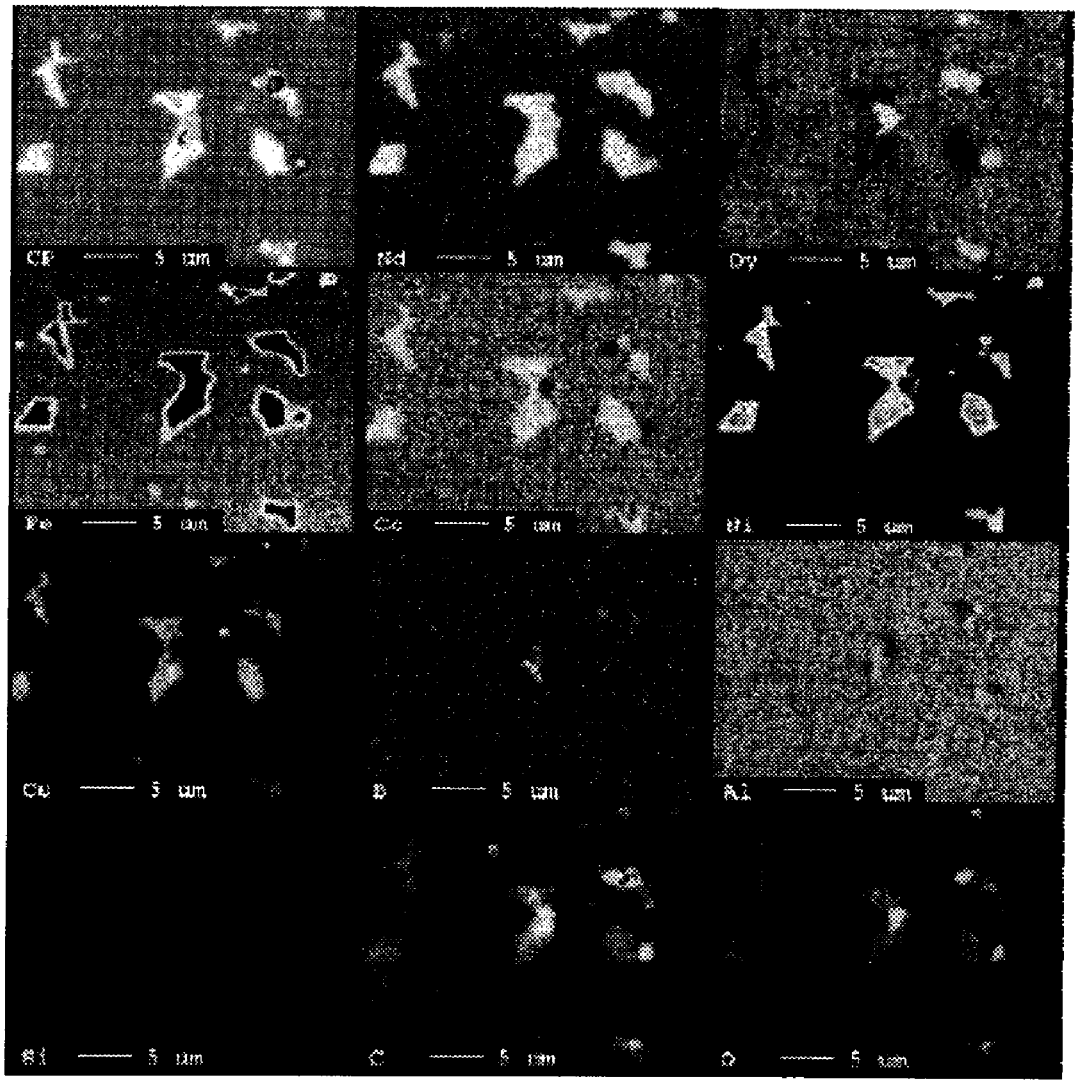
FIG. 2 is an electron micrograph and EPMA images of the sintered magnet in Comparative Example 6.

FIGS. 1 and 2 illustrate the electron micrographs and EPMA images in cross section of the sintered magnet blocks in Example 2 and Comparative Example 6, respectively. In FIGS. 1 and 2, an electron micrograph is on the left in the 1st row, and the remaining are EPMA images, the center in the 1st row is an image of Nd, the right in the 1st row is Dy, the left in the 2nd row is Fe, the center in the 2nd row is Co, the right in the 2nd row is Ni, the left in the 3rd row is Cu, the center in the 3rd row is B, the right in the 3rd row is Al, the left in the 4th row is Si, the center in the 4th row is C, and the right in the 4th row is O. In each EPMA image, the corresponding element is present in a whiter area than the surrounding.

FIG. 1 of Example 2 shows that throughout the EPMA images of R (Nd), Co, Ni, Cu, Si, C, and O, these elements are present in the identical areas which are delineated and surrounded by a circle and an oval, demonstrating that a phase of a compound containing R—Co—Si—Ni—Cu—O—C precipitates in the sintered body. FIG. 2 of Comparative Example 6 shows that Si is not found in the areas where R (Nd), Co, Ni, Cu, C, and O are present. It is known for Nd—Fe—B rare earth sintered magnet that the grain boundary phase plays an important role in the development of coercive force and corrosion resistance. It is estimated from these results that the phase of a compound containing R, Co, Si, Ni, and Cu, which has precipitated in the sintered body as a result of multiple addition of Ni, Si, and Cu, contributes to an increase of coercive force and an improvement in corrosion resistance.

Examples 5 to 9 and Comparative Example 7

Starting feeds including Nd, electrolytic iron, Co, ferroboron, Al, Cu, Ni, and ferrosilicon were combined in the following composition (in weight ratio): 27.5 Nd-5.0 Dy-bal Fe-1.0 Co-1.0 B-0.2 Al-z Cu-0.5 Ni-0.6 Si (z=0, 0.05, 0.10, 0.20, 0.40, 1.0). The mixture was melted in a high-frequency furnace in an Ar atmosphere and cast into an ingot. The ingot was subjected to solution treatment in an Ar atmosphere at 1,120° C. for 12 hours. The resulting alloy was crushed in a nitrogen atmosphere to a size of under 30 mesh. On a V-mixer, 0.1 wt % of lauric acid as a lubricant was mixed with the coarse powder. On a jet mill using nitrogen gas under pressure, the coarse powder was finely divided into a powder with an average particle size of about 5 μm. The fine powder was filled into a mold of a compactor, oriented in a magnetic field of 25 kOe, and compacted under a pressure of 0.5 ton/cm$^2$ in a direction perpendicular to the magnetic field. The molded compact was sintered in an Ar atmosphere at 1,100° C. for 2 hours, cooled, and heat treated in an Ar atmosphere at 500° C. for 1 hour. In this way, sintered magnet blocks of different composition were obtained.

The sintered magnet blocks were evaluated for magnetic properties and corrosion resistance. Magnetic properties were measured by a BH tracer. Corrosion resistance was examined by a PCT of holding a sample at 120° C. and 2 atmospheres for 100 hours. A weight loss of the sample per surface area of the sample prior to the test was determined.

The magnetic properties measured and the PCT results are shown in Table 2. It is seen from Table 2 that although the sample of Comparative Example 7 to which Cu was not added had a coercive force as low as 13.95 kOe, the samples of Examples 5 to 9 to which Cu was added exhibited an increased coercive force. It is demonstrated that addition of either one of Si and Cu is less effective, and addition of both Si and Cu is more effective for preventing any loss of coercive force by addition of Ni. The sample of Comparative Example 7 to which Cu was not added had poor corrosion resistance. The samples of Examples 5 to 9 prove that simultaneous addition of Si, Cu, and Ni is effective for achieving high corrosion resistance.

TABLE 2

| | | Ni (wt %) | Si (wt %) | Cu (wt %) | Br (kG) | iHc (kOe) | Weight loss by PCT (g/cm$^2$) |
|---|---|---|---|---|---|---|---|
| Example | 5 | 0.5 | 0.6 | 0.05 | 12.49 | 18.11 | 0.5 |
| | 6 | 0.5 | 0.6 | 0.10 | 12.47 | 21.59 | 0.3 |
| | 7 | 0.5 | 0.6 | 0.20 | 12.42 | 23.03 | 0.3 |
| | 8 | 0.5 | 0.6 | 0.40 | 12.26 | 23.88 | 0.2 |
| | 9 | 0.5 | 0.6 | 1.00 | 11.88 | 24.02 | 0.3 |
| Comparative Example | 7 | 0.5 | 0.6 | 0 | 12.50 | 13.95 | 3.9 |

Japanese Patent Application No. 2010-111743 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A R-T-B rare earth sintered magnet in the form of a sintered body having a composition consisting essentially of, in % by weight, 26 to 36% of R,
0.5 to 1.3% of B,
0.1 to 2.0% of Ni,
0.1 to 3.0% of Si,
0.05 to 1.0% of Cu,
0.05 to 4.0% of M, and
the balance of T and incidental impurities,
wherein R is one or more element selected from rare earth elements including Y and Sc,
T is Fe or Fe and Co,
M is one or more element selected from the group consisting of Ga, Zr, Nb, Hf, Ta, W, Mo, Al, V, Cr, Ti, Ag, Mn, Ge, Sn, Bi, Pb, and Zn, and
a phase of compound containing R, Co, Si, Ni and Cu precipitates within the sintered body.

2. The R-T-B rare earth sintered magnet of claim 1 wherein the incidental impurities comprises one or more element selected from O, C, and N.

3. The R-T-B rare earth sintered magnet of claim 2 wherein the sintered body has an oxygen (O) content of up to 8,000 ppm, a carbon (C) content of up to 2,000 ppm, and a nitrogen (N) content of up to 1,000 ppm.

4. The R-T-B rare earth sintered magnet of claim 1 wherein the sintered body contains a $R_2$-$T_{14}$-$B_1$ phase as the primary phase, said phase having an average grain size of 3.0 to 10.0 μm.

5. The R-T-B rare earth sintered magnet of claim 1 wherein a phase of a compound containing R, Co, Si, Ni, Cu and one or more of O, C and N precipitates within the sintered body.

* * * * *